United States Patent [19]

Saunders

[11] 4,352,635

[45] Oct. 5, 1982

[54] MULTI-SPEED FAN ASSEMBLY

[75] Inventor: James F. Saunders, Onalaska, Wis.

[73] Assignee: The Trane Company, La Crosse, Wis.

[21] Appl. No.: 169,333

[22] Filed: Jul. 16, 1980

[51] Int. Cl.[3] ..... F04B 49/02; F04B 35/04; H02D 1/58

[52] U.S. Cl. ..... 417/16; 417/12; 417/32; 417/362; 318/102; 236/1 EA; 236/49

[58] Field of Search ..... 417/16, 374, 362, 12, 417/32; 318/101, 102; 236/1 EA, 49, DIG. 9

[56] References Cited

U.S. PATENT DOCUMENTS

| | | | |
|---|---|---|---|
| 2,073,404 | 3/1937 | Hobbs | 417/360 |
| 2,252,762 | 8/1941 | Feldhausen | 318/102 X |
| 2,397,183 | 3/1946 | Kilgore et al. . | |
| 2,936,107 | 5/1960 | Blackburn | 417/362 X |
| 3,650,633 | 3/1972 | Benoit | 417/362 UX |
| 4,092,088 | 5/1978 | Nemesi | 417/362 X |
| 4,108,580 | 8/1978 | Felter | 417/362 |

*Primary Examiner*—Richard E. Gluck
*Attorney, Agent, or Firm*—Carl M. Lewis; Peter D. Ferguson; Ronald M. Anderson

[57] ABSTRACT

Apparatus for rotating a fluid impeller of a centrifugal or axial flow fan, at multiple speeds. A fan is provided with a first and a second electric motor for drivingly rotating a fluid impeller at relatively fast and slow speeds, respectively. The rotor of the first motor directly drives the fluid impeller; the second motor is connected to the impeller shaft of the fan through a belt drive, with pulleys sized to reduce the impeller's rotational speed relative to that of the second motor.

Only one of the motors is provided with a start winding. Control means selectively energize the first and second motors, and are operative to energize the one motor long enough to bring the other motor up to operating speed.

9 Claims, 7 Drawing Figures

FIG. 1
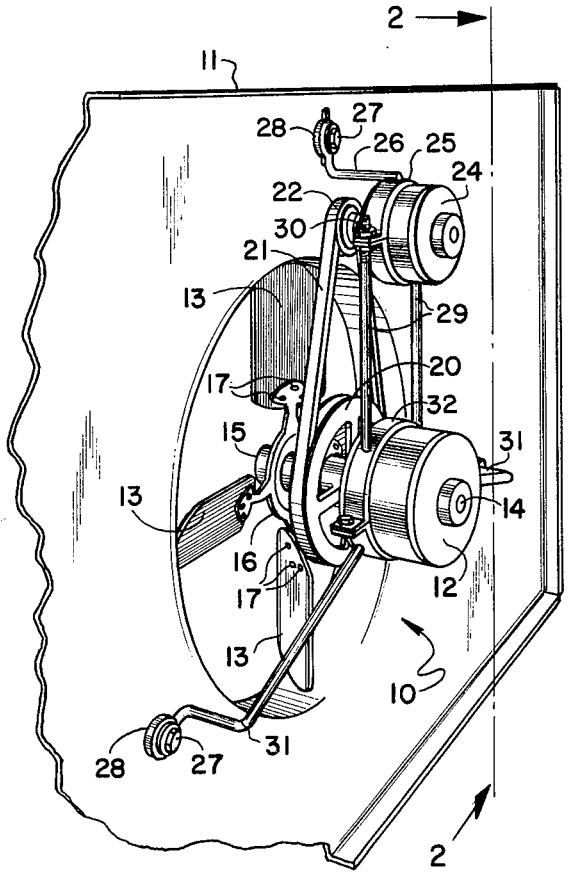
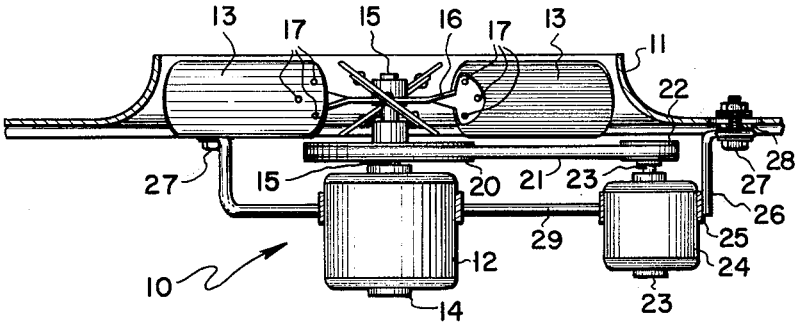
FIG. 2

FIG. 5A
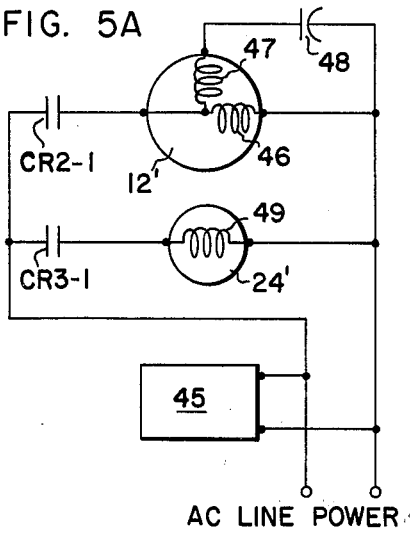
FIG. 4
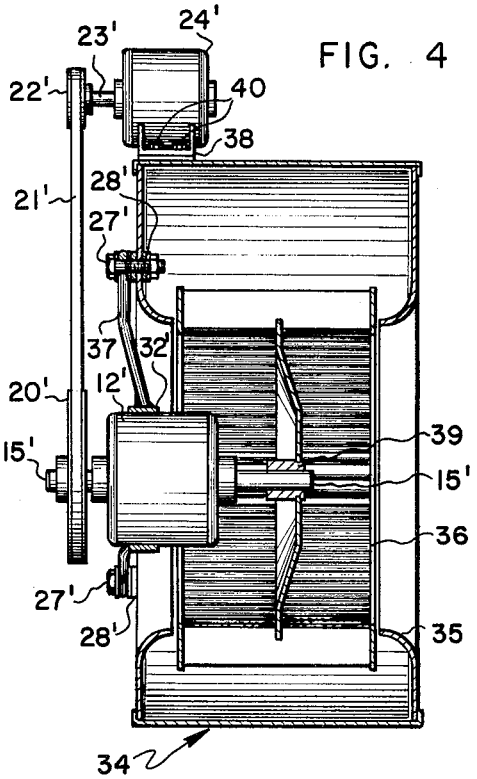
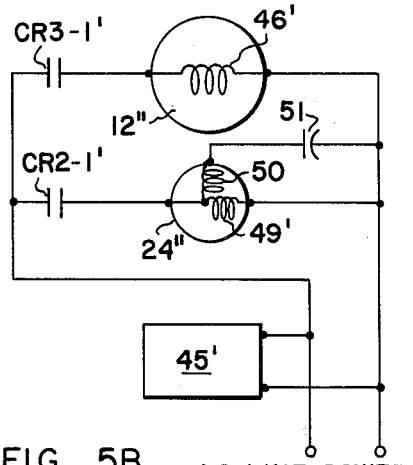
FIG. 5B
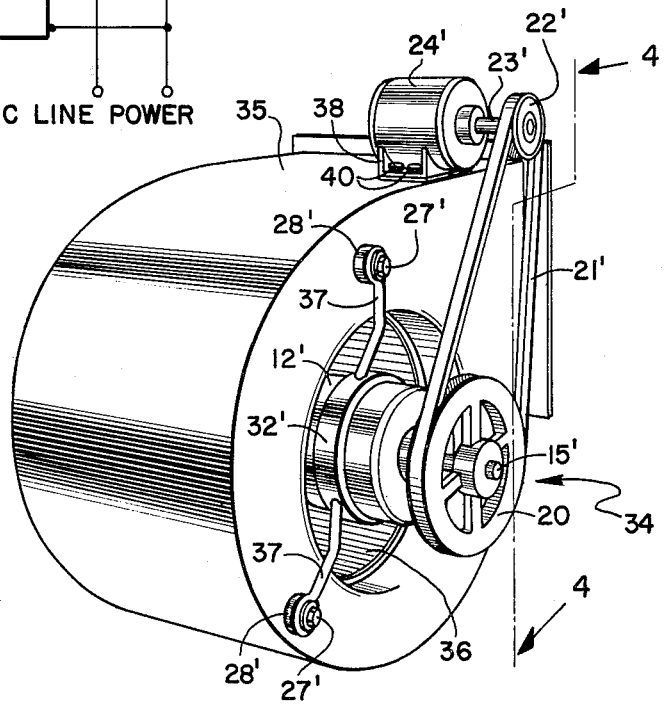
FIG. 3

MULTI-SPEED FAN ASSEMBLY

DESCRIPTION

1. Technical Field

This invention generally pertains to multi-speed fans and specifically to fans having two motors to turn an impeller at different speeds.

2. Background Art

There are many applications for both centrifugal and propeller type fans in which it is desirable to operate the fan at more than one speed. For example, in an air conditioning system, substantial energy savings are possible if the capacity of the compressor and the indoor and outdoor fan speed are reduced in response to a low temperature conditioning load. Studies have shown that the cooling requirements of an average application having a properly sized cooling system may be satisfied approximately 80% of the time by refrigerant compressors and fans operating at 50% of maximum rated capacity. If the fans are designed to be energy efficient at the low speed, this will effect a significantly lower operating cost for the system.

Multiple speed capability in a single motor is possible using tapped windings, or by using one-half the total number of poles of the motor for high speed and the full number of poles for low speed. Due to a high slip rate at low speeds and the relatively high cost of such specially designed motors, these methods are both inefficient and impractically expensive.

An alternative approach is to use a separate motor for driving the fan impeller at each speed at which it is to operate. This allows selection of the motors for optimum size and efficiency. U.S. Pat. Nos. 2,073,404; 2,397,183; and 2,936,107 all disclose the use of multiple motors to drive a fluid impeller. The '404 patent shows high and low speed motors mounted on opposite ends of an impeller shaft. The motors are selectively operable to turn the impeller at a high and a low speed. In the fluid impeller drive described in the '183 patent, a DC motor rotates a propeller at low speeds and an AC motor, which has two sets of interleaved windings, rotates it at high speeds. The '107 patent shows a large high speed motor connected to a vacuum blower by a drive shaft and a smaller motor connected to rotate the same shaft at slower speed, through a reduction gear and a belt and pulley drive.

A two motor fan drive, implemented as described in the prior art discussed above, would likely be too inefficient and expensive for use in an air conditioning system. For example, if, as in the '404 patent, two motors were connected at opposite ends of the impeller shaft for direct drive of an indoor fan, the low speed motor would have to turn too slowly to be efficient. Use of a geared speed reduction assembly, as in the '107 patent, prohibitively increases the price of a fan drive. Indeed, the cost of two complete motors for each fan is relatively high, and might not be justified by the expected increase in the fan's energy efficiency.

In consideration of these problems, it is an object of the present invention to provide a low cost, energy efficient, multi-speed fan assembly.

A further object of this invention is to optimize the energy efficiency of the multi-speed fan drive when it is drivingly rotating the fluid impeller at a relatively slow speed.

A still further object of this invention is to reduce the total cost of the motors used to drivingly rotate the fluid impeller at multiple speeds by eliminating the start winding in one of the motors.

These and other objects of the present invention will be apparent from the description of the preferred embodiment and by reference to the attached drawings.

DISCLOSURE OF THE INVENTION

Apparatus is disclosed for a multi-speed fluid impeller. A first electric motor has a rotor attached to a shaft for drivingly rotating a fluid impeller which is centrally connected to the shaft. A second electric motor has a rotor drivingly connected to the shaft to rotate the impeller at a slower speed than the first electric motor. Only one of the first and second electric motors is provided with a start winding.

Control means selectively energize the first and second electric motors and are operative to energize said one of the electric motors long enough to bring the other up to operating speed when energizing the other motor from a standing start.

BRIEF DESCRIPTION OF THE DRAWINGS

FIG. 1 is a perspective view of the subject invention as applied to an axial flow propeller type fan.

FIG. 2 is a sectional view of the embodiment shown in FIG. 1, taken along section line 2—2.

FIG. 3 is a perspective view of a second embodiment of the subject invention, as it is applied to a centrifugal fan.

FIG. 4 is a sectional view of the second embodiment shown in FIG. 3, taken along section line 4—4.

FIGS. 5A and 5B show two embodiments of a simplified electrical circuit schematic for the subject invention.

BEST MODES FOR CARRYING OUT THE INVENTION

Figure 6:
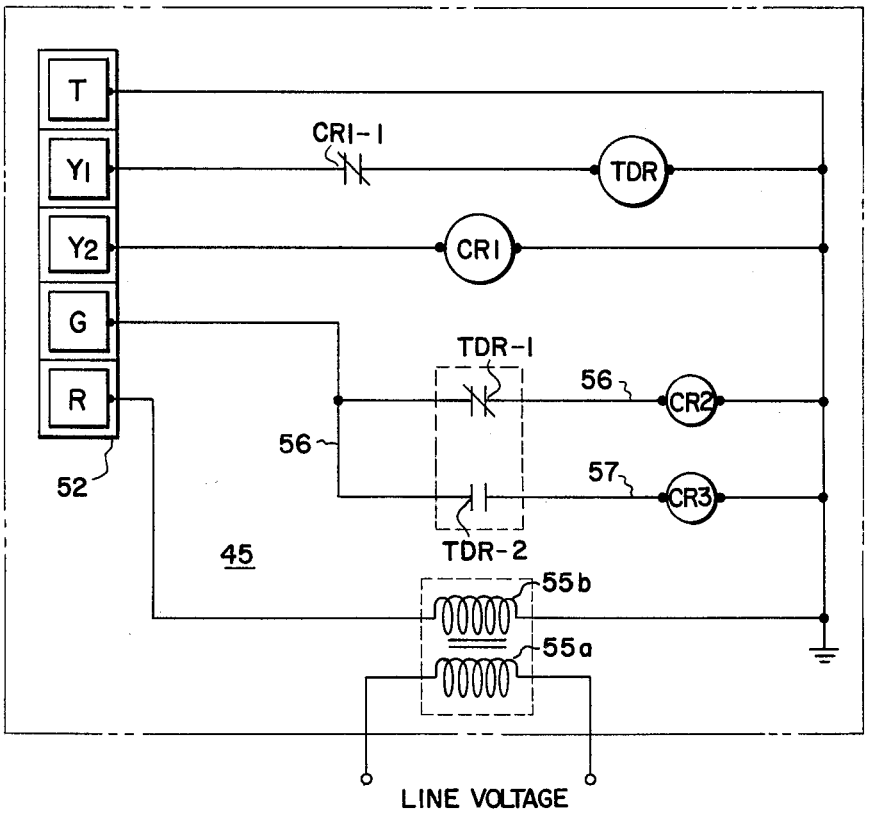
FIG. 6 shows the electrical circuit schematic for the control means used to selectively energize the high speed and low speed motors of the invention, for either the centrifugal fan or the propeller type fan application.

With reference to FIGS. 1 and 2, the subject invention is shown applied to an axial flow propeller type fan assembly, generally designated by reference number 10. Such an assembly might for example be used as the top deck of an outdoor condenser unit for an air conditioning system, or in other air handling applications. The apparatus 10 is supported by housing 11, which also serves to direct the air flow therethrough.

A first electric motor 12 is disposed to drive fluid impeller blades 13 to cause air to flow through the fan housing 11. The first motor 12 includes a rotor 14 (only end thereof shown) connected to an impeller drive shaft 15 to drivingly rotate a collar assembly 16. The collar assembly 16 is attached to the fluid impeller blades 13 using rivets 17 or by other suitable means, such as by spot welding. The collar assembly 16 is pressed onto the impeller drive shaft 15 and may otherwise be prevented from slipping thereon by the use of a key and/or set-screw. A pulley 20 is likewise secured to the impeller drive shaft 15 between first motor 12 and collar assembly 16.

The pulley 20 is drivingly connected to a relatively smaller diameter pulley 22, by means of a V-belt 21. The rotor shaft 23 of a relatively smaller motor 24 is also drivingly secured to the small pulley 22 by press fit, key, and/or set-screw.

In the preferred embodiment, the ratio of the diameter of pulley 20 to the diameter of pulley 22 is determined as a function of the rotational speed of the smaller motor 24 such that the impeller fan blade speed (when driven by the smaller motor 24) is approximately 50% of the speed at which the impeller blade is driven by the larger motor 12. Of course in some applications, other speed ratios may be desirable and the pulleys 20 and 22 would be sized accordingly. Motors 12 and 24 are selected to optimize the efficiency of the fan assembly 10 in accord with the power required for the particular air flow application.

The smaller motor 24 is held in position by an arcuate-shaped compression collar 25 which is welded to a support rod 26, attached to the fan housing 11. The support rod 26 is connected through a slotted hole in the fan assembly 11 by bolt, washer, and nut assembly 27 in conjunction with a vibration damper, rubber grommet 28.

Tension adjustment and support rods 29 extend through flanges in the compression collar 25 at each side of the smaller motor 24. The ends of the rods 29 adjacent the motor 24 are threaded and provided with nuts 30 which are used to adjust the tension in V-belt 21, and to clamp the compression collar 25 about the circumference of smaller motor 24. The other end of tension adjustment and support rods 29 are welded to a larger arcuate-shaped compression collar 32, clamped about the circumference of the larger motor 12. Two other support rods 31 are welded to the compression collar 32 of the larger motor 12, equally spaced apart from each other and from the two tension adjustment and support rods 29. Each of the support rods 31 are connected to the fan housing 11 by bolt, washer, and nut assemblies 27 and rubber grommets 28. Other methods of mounting the two motors 12 and 24 will be apparent to those skilled in the art.

Turning now to FIGS. 3 and 4, a second embodiment of the subject invention is shown applied to a centrifugal fan assembly, generally denoted by the reference number 34. A scroll-shaped sheet metal housing 35 is provided, having air inlets at each side and an outlet directed generally tangential to the circumference of a centrifugal fan impeller wheel 36.

A relatively large high speed fan motor 12' is disposed in the center of one of the inlets at one side of the impeller wheel 36. The motor 12' is held in position by an arcuate-shaped compression collar 32' to which three radially extending support rods 37 are welded, spaced at approximately 120° intervals around the compression collar 32'. The support rods 37 are connected at their outer ends to housing 35 by means of bolt, washer, and nut assemblies 27' which extend through the housing in rubber grommets 28'. A drive shaft 15' extends from one end of motor 12' into the interior of the fan housing 35, and is secured to a collet 39 of the centrifugal fan impeller wheel 36 by press fit, key, and/or set-screw. A pulley 20' is similarly secured to the drive shaft 15' where it extends from the opposite end of the motor 12'.

A V-belt 21' connects the pulley 20' to a relatively smaller diameter pulley 22'. A rotor shaft 23' of a smaller motor 24' is drivingly attached to pulley 22'. Bracket means 38 secure the smaller motor 24' to the exterior of housing 35 with bolts 40 which extend through slotted holes in the housing 35, thereby enabling the position of the smaller motor 24' to be adjusted to properly tension the V-belt 21'. As explained above, the ratio of the diameters of pulleys 20' and 22' should be determined such that the smaller motor 24' will rotate the impeller wheel 35 at a relatively slower speed, which is in the desired proportion to that at which it is rotated by the larger motor 12'.

In both of the embodiments shown in FIGS. 1 through 4, it is expected that the large motors 12 and 12', and the relatively smaller motors 24 and 24' are selectively energized at their rated line voltage by control means including relays or solid-state switching. FIGS. 5A and 5B show electrical schematic diagrams for two separate embodiments of the invention employing relay switching. The schematic diagrams are applicable to both the axial flow propeller type fan assembly 10 shown in FIGS. 1 and 2 and to the centrifugal fan assembly 34 shown in FIGS. 3 and 4. For purposes of applying the schematic circuits shown in FIGS. 5A and 5B to the centrifugal fan assembly 34, reference numerals 12 or 12'', and 24 or 24'' should be understood to also represent numerals 12' and 24', respectively.

In FIG. 5A, the circuit for larger electric motor 12 includes external capacitor 48, start winding 47, and run winding 46. By comparison the circuit for smaller motor 24 includes only a run winding 49. Control means 45 are operative to selectively energize motor 12 and motor 24 by causing relay contacts CR2-1 or CR3-1 to close. Similarly, in FIG. 5B, the smaller motor 24'' includes capacitor 51, start winding 50, and run winding 49, whereas the relatively larger motor 12'' includes only the run winding 46'. In this embodiment, control means 45' are operative to selectively energize the larger motor 12'' and the smaller motor 24'' by closure of relay contacts CR3-1' or CR2-1', respectively.

Operation of the fan assemblies can easily be understood by reference to FIG. 6 wherein a simplified electrical schematic diagram of the control means 45 is shown. It should be noted that the control means 45 shown in FIG. 6 are operative only with the motors 12' and 24' configured as illustrated in FIG. 5A, or motors 12 and 24, similarly configured. Further, the control means illustrated in FIG. 6 are specifically designed for energizing an indoor blower of an air conditioning system in response to a two-stage thermostat which is not shown. Modifications to the control means for use in other applications should be apparent to those skilled in the art.

The control lines from the thermostat are connected to the control means 45 illustrated in FIG. 6 at terminal strip 52, wherein each terminal is labeled with letter designations (T, $Y_1$, $Y_2$, G, and R) as is conventional in the art. Power for the control means 45 is suppled via a voltage reduction transformer 55. Transformer 55 reduces a line voltage e.g., 120 volts AC, applied to the primary **55*a*, to approximately 24 volts AC. One lead of the 24 volt AC secondary 55*b* is connected to a ground bus which is in common with terminal T of terminal strip 52. The other lead from the secondary 55*b* is connected to terminal R of terminal strip 52**. Note that relay coils controlling refrigerant compressors are not shown.

Should the external thermostat sense a demand for air conditioning, a switch closes in the thermostat to externally connect the voltage present on terminal R to terminal $Y_1$. The voltage on terminal $Y_1$ energizes the coil of time delay relay TDR through the normally closed contacts CR1-1 of relay CR1. The voltage present on terminal R is also then connected to the thermostat to terminal G, which is connected to the coil of relay CR2 through normally closed contacts TDR-1. Operation of relay coil CR2 closes contacts CR2-1 (reference FIG. 5A), energizing larger motor 12' with AC line power. In this embodiment, motor 12' is provided with a start winding 47, which enables it to drivingly rotate the fluid impeller blades 36 up to the higher operating speed. Pulleys 20' and 22', and V-belt 21' transfer the driving torque of motor 12' to the rotor shaft 23' of the smaller electric motor 24'. In approximately 5 seconds, the time interval of time delay relay TDR elapses, causing normally close contacts TDR-1 to open and normally open contacts TDR-2 to close. Closure of contacts TDR-2 energizes the coil of relay CR3 causing contacts CR3-1 to close, thereby energizing the run winding 49 of motor 24'. When normally close contacts TDR-1 open, relay coil CR2 is de-energized, opening contacts CR2-1 and de-energizing the large motor 12'. Motor 24' does not require a start winding since it has been brought up to greater than its normal operating speed during the time that the relatively larger motor 12' is energized.

Should the external thermostat sense the requirement to energize a second stage of cooling, the voltage on terminal R is externally connected to terminal $Y_2$ through a switch closure in the external thermostat, thereby energizing the coil of relay CR1. This causes the normally close contacts CR1-1 to open, de-energizing time delay relay TDR. Closure of normally close contacts TDR-1 again energizes relay coil CR2, closing contacts CR2-1 and energizing the larger motor 12'. Likewise contacts TDR-2 are opened thereby deenergizing the coil of relay CR3, which opens contacts CR3-1 and de-energizes motor 24'.

It should be apparent from the foregoing discussion, that the impeller blades 13 turn at high speed whenever the second stage of cooling is energized and turn at a relatively lower speed when only the first stage of cooling is energized. In addition, when the first stage of cooling is energized, the high speed (larger) motor is energized for approximately 5 seconds through time-delay relay TDR in order to bring the slower and smaller motor 24 up to operating speed.

If the smaller motor 24" is provided with a start winding, as shown in FIG. 5B, it is used to start the larger motor. The control means 45, illustrated in FIG. 6, is modified to become control means 45' by replacing relay coil CR1 with time delay relay coil TDR, thereby deleting the relay CR1 and its contact CR1-1, deleting the lead between $Y_1$ and the ground bus, and by interchanging leads 56 and 57 so that contact TDR-1 is connected to relay coil CR3 and contact TDR-2 is connected to relay coil CR2. This enables the smaller motor 24" to operate briefly in order to start the larger motor 12", when the second stage of cooling is energized.

Other designs for control means 45 and 45' are contemplated within the scope of the claims which define this invention. For example, it should be apparent that a microprocessor is easily programmed to selectively energize the electric motors, and by using the microprocessor internal time base, the control may effect the required time interval for energizing the one motor which includes a start winding in order to bring the other motor up to operating speed. It is also contemplated that the present invention may be used in conjunction with many other applications besides air conditioning, heating, and ventilation. Under certain circumstances, it may also be desirable to use multi-speed motors either for the larger or the smaller motor to provide additional ranges of speed control for the fan assembly, even if this does somewhat reduce the overall efficiency of the unit.

In the preferred embodiment, a permanent split phase capacitor motor is used as the motor which includes the start winding, and a simple induction motor is used for the motor which does not include a start winding; however, it may be preferable in certain applications to use two permanent split phase capacitor motors, or other types of motors in combination, for driving the fan at both the low and high speeds.

While the present invention has been described with respect to the preferred embodiments, it is to be understood that further modifications thereto would become apparent to those skilled in the art, which modifications lie within the scope of the present invention, as defined in the claims which follow.

I claim:

1. A multi-speed fluid impeller apparatus for use in moving air in a system having two or more stages of operation, said apparatus comprising a. a rotating fluid impeller;

b. a shaft centrally connected to the fluid impeller;

c. a first electric motor, having a rotor attached to the shaft for drivingly rotating the impeller;

d. a second electric motor, having a rotor drivingly connected to the shaft to rotate the impeller at a slower speed than the first electric motor, wherein only one of the first and the second electric motors is provided with a start winding and the other is not; and e. control means for selectively energizing the first and second electric motors, the second electric motor being energized during operation of the first stage and the first electric motor during operation of all stages, said control means being further operative to energize said one of the electric motors long enough to bring said other electric motor up to operating speed and then energizing said other electric motor to start it.

2. A two stage fluid impeller apparatus, for use in moving air in a two stage system, comprising a. a rotating fluid impeller;

b. a shaft centrally connected to the fluid impeller;

c. a first electric motor, having a rotor directly attached to the shaft for rotating the impeller at the same speed as the rotor;

d. a second electric motor, having a rotor connected to drive the fluid impeller, wherein one of the first and second electric motors is provided with a start winding and the other is not;

e. means for drivingly connecting the rotor in the second electric motor to the fluid impeller and for reducing the rotational speed of the fluid impeller relative to the speed of the rotor in the second electric motor; and f. control means for selectively energizing the first electric motor during second stage operation of the system and the second electric motor during the first stage operation of the system to effect higher and lower rates of fluid flow, respectively, said control means being further operative to energize said one of the electric motors long enough to bring said other electric motor up to operating speed and then energizing said other electric motor to start it.

3. The apparatus of claim 2 wherein the speed reducing means comprises a. a first pulley attached to the rotor of the second electric motor;

b. a second pulley, relatively larger in diameter than the first pulley, mounted on the shaft; and c. a belt drivingly connecting the first and second pulleys.

4. The apparatus of claims 1 or 2 wherein the second electric motor is substantially less powerful and consumes substantially less electrical energy when drivingly rotating the impeller than does the first electric motor.

5. The apparatus of claim 4 wherein said one of the electric motors is a permanent split-phase capacitor motor, and said other electric motor is a simple induction motor.

6. The apparatus of claim 4 wherein the fluid impeller is a centrifugal type fan.

7. The appartus of claim 4 wherein the fluid impeller is an axial flow propeller type fan.

8. The apparatus of claim 4 further comprising housing means for directing the fluid flow and for supporting the shaft, the first electric motor, and the second electric motor.

9. The apparatus of claim 8 wherein the second electric motor is secured to the housing means near the periphery thereof.

* * * * *